US005586919A

United States Patent [19]

Ritson

[11] Patent Number: 5,586,919

[45] Date of Patent: Dec. 24, 1996

[54] BATTERY CONNECTOR

[76] Inventor: John D. Ritson, 12 Northwoods Rd., Granby, Conn. 06060

[21] Appl. No.: 414,419

[22] Filed: Apr. 3, 1995

[51] Int. Cl.[6] ..... H01R 4/38

[52] U.S. Cl. ..... 439/757; 439/835

[58] Field of Search ..... 439/268, 757, 439/759, 761, 772, 773, 835, 838, 756

[56] References Cited

U.S. PATENT DOCUMENTS

| | | | |
|---|---|---|---|
| 3,538,490 | 8/1968 | Juggins | 439/757 |
| 3,613,053 | 10/1971 | Thomas | 439/762 |
| 4,695,118 | 9/1987 | Magdesyan et al. | 439/756 |

FOREIGN PATENT DOCUMENTS

| | | | |
|---|---|---|---|
| 9212553 | 7/1992 | Brazil | 439/772 |

*Primary Examiner*—Neil Abrams
*Assistant Examiner*—Barry Matthew L. Standig
*Attorney, Agent, or Firm*—Perman & Green

[57] ABSTRACT

A connector for quickly clamping onto and releasing from an associated generally cylindrical battery post which includes a unitary metallic body having first and second elongated portions disposed in generally parallel spaced relationship with the first and second elongated portions having respective first and second cylindrical section shaped portions disposed therein in opposed relationship. The apparatus also includes the first and second opposed cylindrical section shaped portions biased toward each other, whereby good electrical contact is made with the associated generally cylindrical battery post. The apparatus also includes an oblong member disposed intermediate the first and second elongated portions which enables the connector to be easily removed from the associated battery post. The oblong member may be moveable between a first position which does not cause the first and second elongated portions to move apart and a second position which does cause the first and second elongated portions to move apart. The biasing of the connector may be provided by the temper of the material from which the unitary metallic body is manufactured. The opposed portions may have third and fourth generally arcuate opposed faces and the oblong member may be disposed between the third and fourth generally arcuate opposed faces.

9 Claims, 3 Drawing Sheets

BATTERY CONNECTOR

BACKGROUND OF THE INVENTION

Automobile-type batteries have use in many applications today. Some of the places automobile-type batteries are found include cars, trucks, boats, riding lawn mowers, golf carts, and other recreational vehicles and to perform a wide variety of functions, from starting the automobile, boat or lawn mower to running accessories, such as lights, radios televisions and car phones. In addition, contractors use this type of battery in their various equipment.

Many times it becomes necessary to frequently remove the battery. Once such instance arises in marine applications where drained batteries are continually being removed in order to be recharged and freshly charged batteries are being installed. Another instance is winter in the northern portion of the continental United States, Canada and Alaska when the temperature drops below the point where the battery will not function properly. Conventional battery connectors are cumbersome and slow to put on or release from the generally cylindrical battery post. Further, since most connectors are made from soft lead, the constant opening and closing of the connector has a tendency to weaken the connector and cracks may form in the connector.

The prior art includes apparatus that uses a nut and a bolt as the means for holding the connector onto the associated battery post. Traditional connectors are made from soft lead and the nut and the bolt squeeze the two opposite sides together against the associated battery post, thereby making good electrical contact in addition to holding the connector onto the associated battery post. Some newer connectors are shaped similar to the traditional soft lead connectors and also use a nut and a bolt to hold the connector onto the associated battery post, but are made from other electro conductive metals.

It is an object of the invention to provide apparatus that is easy to put on and release from a generally cylindrical battery post.

Yet another object of the invention is to provide apparatus that is easily biased from an open position to a closed position and from a closed position to an open position without the aid of tools.

Still another object of the invention is to provide apparatus that is reliable and durable to withstand the frequent movement between the open position and the closed position.

It is also an object of the invention to provide apparatus which is inexpensive to manufacture as well as require a minimum of labor to install.

Another object of the invention is to provide apparatus that will fit on the posts of almost any brand of automobile battery.

SUMMARY OF THE INVENTION

It has now been found that these and other objects of the invention may be found in a connector for quickly clamping onto and releasing from an associated generally cylindrical battery post. The apparatus includes a unitary metallic body having first and second elongated portions disposed in generally parallel spaced relationship with the first and second elongated portions having respective first and second cylindrical section shaped portions disposed therein in opposed relationship. The apparatus also includes means for biasing the first and second opposed cylindrical section shaped portions toward each other, whereby good electrical contact is made with the associated generally cylindrical battery post. The apparatus also includes means for forcing the first and second opposed cylindrical section shaped portions apart, whereby the connector may easily be removed from the associated battery post.

In some forms of the invention, the means for forcing the first and second opposed cylindrical section shaped portions apart includes means disposed intermediate the first and second elongated portions which is movable between a first position which does not cause the first and second elongated portions to move apart and a second position which does cause the first and second elongated portions to move apart.

In some forms of the invention, the means for forcing the first and second opposed cylindrical section shaped portions apart may be generally oblong in cross-section, whereby the distance across the cross-section thereof is substantially greater in a first direction than in a second direction. Movement of the means for forcing the first and second opposed cylindrical section shaped portions to a position where the first direction is substantially perpendicular to the first and second elongated portions will tend to move the first and second elongated portions apart and movement of the means for forcing the first and second opposed cylindrical section shaped portions to a position where the second direction is substantially parallel to the first and second elongated portions will tend to allow the first and second elongated portions to move toward each other.

The apparatus may also include means for biasing provided by the temper of the material from which the unitary metallic body is manufactured.

The apparatus may also include opposed portions having third and fourth generally arcuate opposed faces and the oblong member may be disposed between the third and fourth generally arcuate opposed faces.

BRIEF DESCRIPTION OF THE DRAWING

The invention will be better understood by reference to the accompanying drawing in which.

DESCRIPTION OF THE PREFERRED EMBODIMENT

Figure 1A:
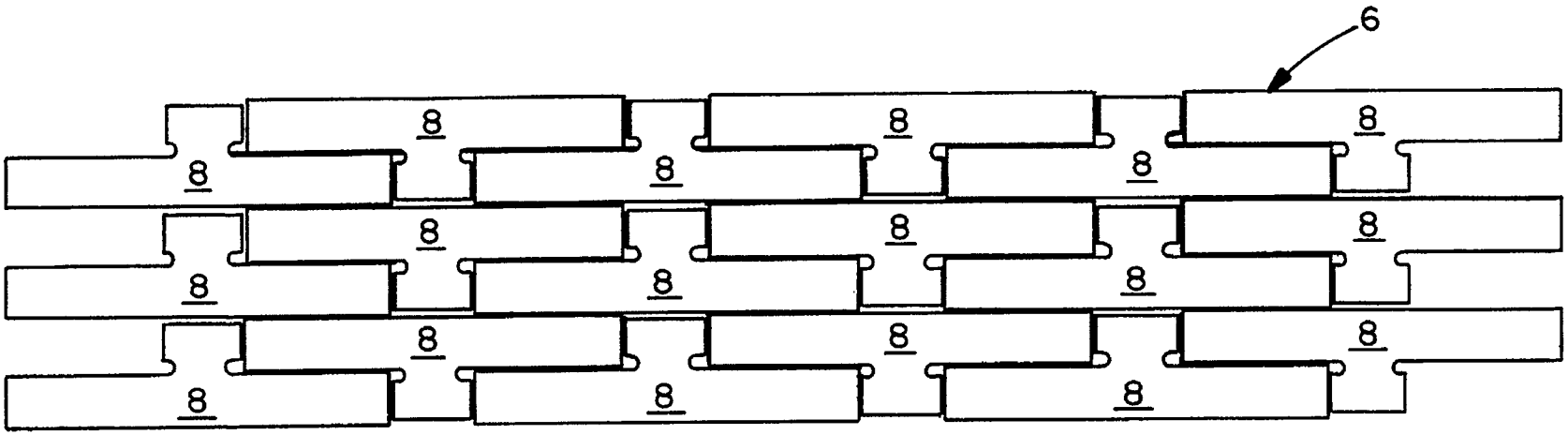
FIG. 1*a* is a top view of a sheet of metal with multiple T-shaped stamping and FIG. 1*b* is a top view of a T-shaped metal piece before it is bent into the unitary metallic body.

Referring now to FIGS. 1–5 there is shown a preferred form of the connector apparatus 10 for quickly clamping onto and releasing from an associated battery post 11 in accordance with a preferred form of the invention. The connector apparatus 10 includes a unitary metallic body 8 having a first elongated portion 12 and a second elongated portion 14 disposed in generally parallel spaced relationship.

The first elongated portion 12 has a cylindrical section shaped portion 22 and the second elongated portion 14 has a cylindrical section shaped portion 24. The cylindrical section shaped portions 22 and 24 are disposed in an opposed relationship. The elongated section 12 contains a generally arcuate face 26 and the elongated section 14 contains a generally arcuate face 28 with the generally arcuate face 26 opposite the generally arcuate face 28. The relationship of the elongated portions 12 and 14, the cylindrical section shaped portions 22 and 24, and the generally arcuate faces 26 and 26 in the unitary metallic body 8 are illustrated in great detail in FIGS. 2*a* and 2*b*.

Figure 3:
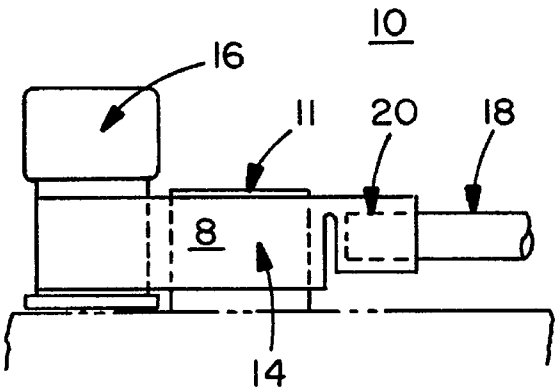
FIG. 3 is a fragmentary side elevational view of the connector in a closed position.
Figure 2B:
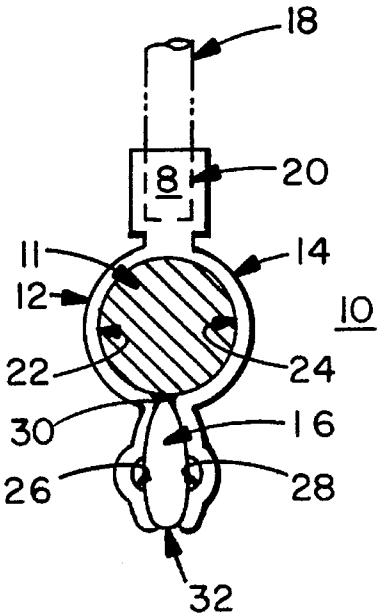
FIG. 2*b* is a top view illustrating the connector in a closed position.
Figure 4:
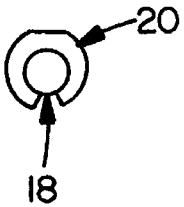
FIG. 4 is a fragmentary rear elevational view of the means for joining the connector to the associated cable.
Figure 2A:
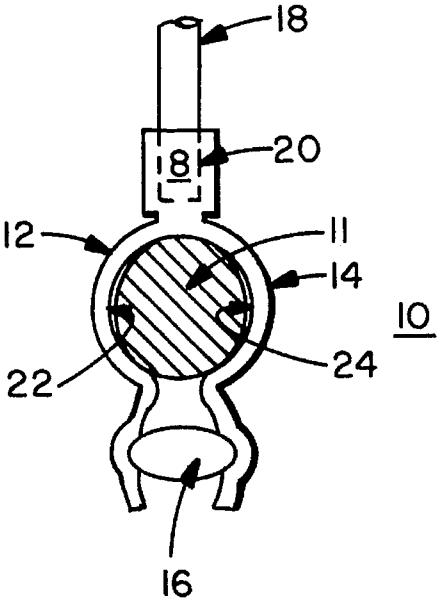
FIG. 2*a* is a top view illustrating the connector in an open position.
Figure 5:
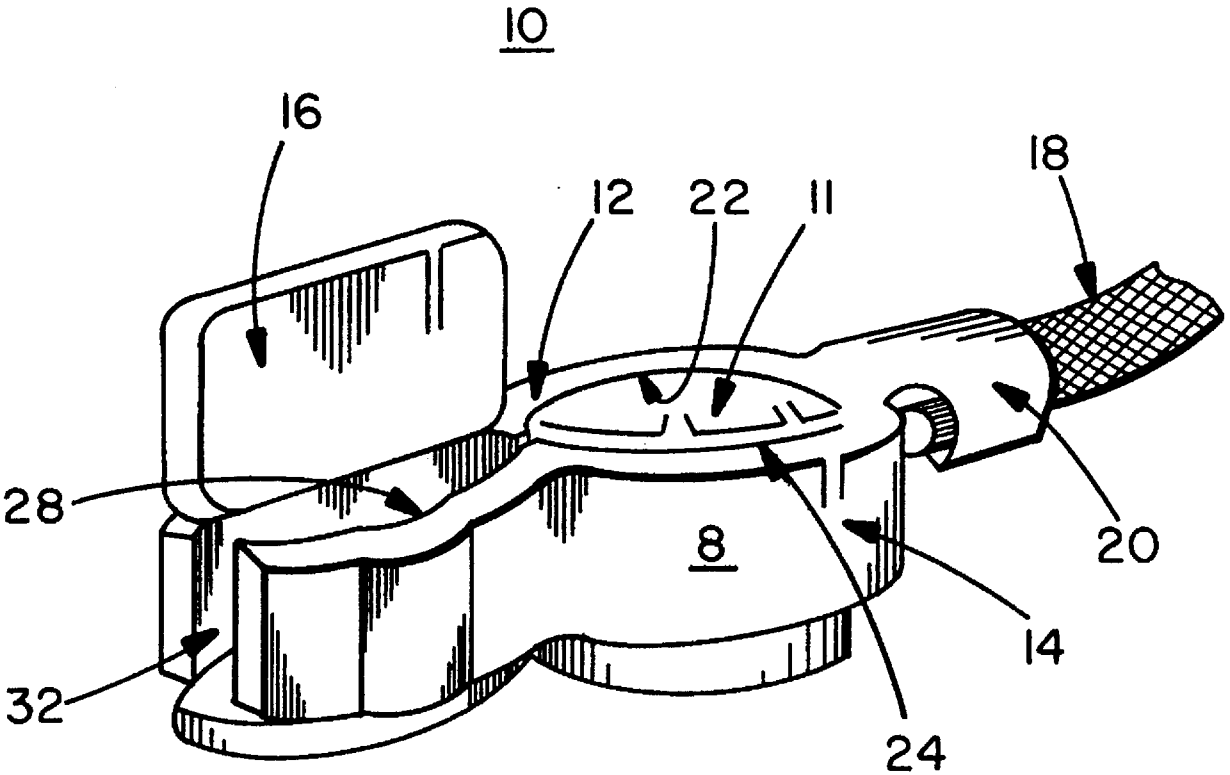
FIG. 5 is a side elevational view of the connector in a closed position on the generally cylindrical battery post.

An oblong member 16 having rounded edges 30 and 32 is disposed between the generally arcuate faces 26 and 28 of the elongated portions 12 and 14. The rounded edges 30 and 32 are parallel to the associated battery post 11. The oblong member 16 is movable between a first position which does not cause the elongated portions 12 and 14 to move apart and a second position which does cause the elongated portions 12 and 14 to move apart, enabling the connector apparatus 10 to be released from the associated battery post 11. In the first position, the oblong member 16 is generally parallel to the elongated portions 12 and 14 while in the second position the oblong member 16 is generally perpendicular to the elongated portions 12 and 14. The rounded edges 30 and 32 mate with the generally arcuate faces 26 and 28 when the oblong member 16 is in the second position. The oblong member 16 is constructed from a nylon material but other materials such as other plastics or various metals may be used. The second position is illustrated in FIG. 2*a* and the first position is illustrated in FIGS. 2*b*, 3 and 5.

In certain circumstances, the oblong member 16 may cause interference by being taller than the associated battery post 11. The connector apparatus 10 may be constructed so that the rounded ends 30 and 32 of oblong member 16 are perpendicular to the associated battery post 11. The oblong member 16 is disposed between the generally arcuate faces 26 and 28 of the elongated portions 12 and 14. In this configuration, the oppositely disposed generally arcuate faces 26 and 28 extend partially through the length of the elongated portions 12 and 14.

The unitary metallic body 8 contains a tab 20 which is used to connect the unitary metallic body 8 to the associated cable 18. The tab 20 is in alignment with the oblong member 16 when the oblong member 16 is in the first position. The ends of tab 20 wrap around the bare wire of the associated cable 18 to form a good electrical connection. This is shown in great detail in FIG. 4. Tab 20 and the associated cable 18 are also shown in FIGS. 2*a*, 2*b*, 3 and 5.

In many batteries today, the associated positive battery post 11 and the associated negative battery post 11 differ in diameter. In addition, the associated battery post 11 is slightly tapered with the diameter of the base slightly larger than the diameter of the top. The cylindrical section shaped portions 22 and 24 are canted to conform to the taper of the standard battery terminal 11. The canted cylindrical section shaped portions 22 and 24 encircle the associated battery post 11 when the oblong member 16 is generally parallel to the elongated portions 12 and 14. The canted cylindrical section shaped portions 22 and 24 allow for good electrical contact on either the associated positive battery post 11 or the associated negative battery post 11.

Figure 1B:
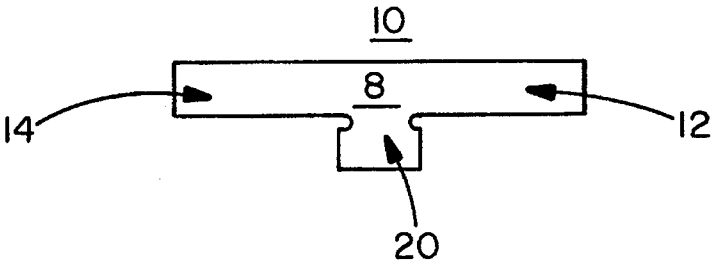

The unitary metallic body 8 is stamped from a single sheet of metal 6 and then bent into shape. FIG. 1*a* illustrates the multiple stamping of unitary metallic bodies 8 in a single sheet of metal 6. The unitary metallic body 8 can be manufactured from any metal that meets the conductor apparatus 10's requirements of electro conductivity and temper of the material that allows the unitary metallic body 8 to spring back and forth. The thickness of the unitary metallic body 8 will vary for the specific application. The material for manufacturing the unitary metallic body 8 may be a hard stainless steel, such as 400 series or Inconel 60 Type or phosphorous bronze or steel with inlay such as copper or stainless steel. The unitary metallic body 8, after it is stamped from the sheet of metal 6, is T-shaped and is bent to form the elongated portions 12 and 14, the cylindrical section shaped portions 22 and 24, the generally arcuate faces 26 and 28 and the tab 20. FIG. 1*b* illustrates the unitary metallic body 8 after it is stamped from the sheet of metal 6 and before it is bent.

The batteries will differ in size depending on its designed use. For example, an automobile battery used in cars and trucks is smaller than a recreational vehicle battery. A battery for marine use differs in size from automobile batteries. Since the battery sizes differ, the battery terminals 11 differ in diameter. The connector apparatus 10 is manufactured in various sizes so that when the cylindrical section shaped portions 22 and 24 encircle the terminal 11, the cylindrical section shaped portions 22 and 24 conform to the diameter of the terminal 11, thereby making good electrical contact. Each size battery will have a respective connector apparatus 10.

Although the connector apparatus 10 has been described as a single unit to be attached to an associated cable 18, it is envisioned that the connector apparatus 10 and cable 18 may also be packaged and sold as a single unit.

The invention has been described with reference to its illustrated preferred embodiment. Persons skilled in the art of such devices may upon exposure to the teachings herein, conceive other variations. Such variations are deemed to be encompassed by the disclosure, the invention being delimited only by the following claims.

Having thus described my invention I claim:

1. A releasable connector for electrically connecting a cable to a generally cylindric battery post comprising:

a body portion adapted for substantially surrounding and clamping the connector to a generally cylindric battery post;

a cable attachment portion connected to said body portion for conducting electricity between said body portion and a cable;

the structure of said body portion being comprised solely of a strip of sheet metal configured to create opposed partially cylindrical section shapes normally inwardly biassed in compression towards one another for clamping about a substantially cylindric battery post; and means associated with each of said partially cylindrical section shapes for moving the normally inwardly biassed partially cylindrical section shapes apart from one another from an otherwise compressing condition about a battery post.

2. A releasable connector as defined in claim 1 further characterized in that said strip of sheet metal has two juxtaposed free ends emanating from each of said partially cylindric section shapes and wherein said means for moving opposed partially cylindrical sectional shapes from one another is disposed adjacent each of said free ends and opposite one another.

3. A releasable connector as defined in claim 2 further characterized in that said means associated with each of said opposed partially cylindrical section shapes includes a generally oblong member in cross section, whereby the distance across the cross section thereof is substantially greater in a first direction than in a second direction and said oblong member including a gripping means for rotating said oblong member from a closed position to cause the substantially greater length of said oblong member to spread apart the normally inwardly biassed partially cylindrical section shapes to relieve compressive force on a battery post terminal.

4. A releasable connector as defined in claim 3 further characterized by said cable attachment portion being integrally formed with said body portion.

5. A releasable connector as defined in claim 4 further characterized in that said body portion being bent to form the opposed partially cylindric section shapes.

6. A releasable connector as defined in claim 5 further characterized in that said sheet of stamped metal is bent to form opposed arcuate recesses each juxtaposed with one of said opposed partially cylindrical shaped sections.

7. A releasable connector as defined in claim 6 further characterized in that said strip of sheet metal being formed from stamped stainless steel.

8. A releasable connector as defined in claim 7 further characterized in that said strip of sheet metal being formed from stamped INCONEL steel.

9. A method of connecting a battery cable to an associated battery terminal comprising the steps of:

providing a piece of sheet metal;

stamping said sheet metal to form a strip which is substantially T-shaped as defined by an elongate portion and a tab portion;

bending said elongate portion of said stamped T-shaped metal strip to form partially cylindric sections which are biassed toward one another by the bending in said sheet material;

spreading the opposed partially cylindric sections apart from an otherwise compressed condition to surround a battery terminal post, and thereafter releasing the otherwise spread partially cylindrical sections so as to clamp the connector about said battery terminal post;

and connecting a cable to said connector by using said tab portion of said T-shaped strip to conduct electricity between the cable and a battery post terminal.

* * * * *